US007637698B2

(12) United States Patent
Meernik

(10) Patent No.: US 7,637,698 B2
(45) Date of Patent: Dec. 29, 2009

(54) TENT GROUND CLOTH WITH DRAINAGE

(76) Inventor: Paul R. Meernik, 26061 Dow, Redford, MI (US) 48239

( * ) Notice: Subject to any disclaimer, the term of this patent is extended or adjusted under 35 U.S.C. 154(b) by 271 days.

(21) Appl. No.: 10/971,751

(22) Filed: Oct. 22, 2004

(65) Prior Publication Data

US 2006/0088389 A1 Apr. 27, 2006

(51) Int. Cl.
*E04H 15/32* (2006.01)
*B32B 3/10* (2006.01)
*E02D 17/20* (2006.01)

(52) U.S. Cl. ..... 405/302.7; 428/131; 5/417; 135/116; 135/120.1

(58) Field of Classification Search ..... 405/302.4, 405/302.6, 302.7; 135/116, 120.1
See application file for complete search history.

(56) References Cited

U.S. PATENT DOCUMENTS 3,809,600 A * 5/1974 Larson ..... 428/131
4,840,829 A * 6/1989 Suzuki et al. ..... 428/131
5,601,906 A * 2/1997 Henry ..... 442/1
6,673,241 B1 * 1/2004 Tung et al. ..... 210/242.1
6,742,203 B2 * 6/2004 Reynolds ..... 5/420
6,845,781 B1 * 1/2005 Brown ..... 135/117
7,059,089 B1 * 6/2006 Fontaine ..... 428/141
2002/0037204 A1 * 3/2002 Vario ..... 410/129
2002/0144633 A1 * 10/2002 Brown ..... 108/90
2004/0062615 A1 * 4/2004 Walsh ..... 405/302.7

OTHER PUBLICATIONS

Boy Scouts of America; Ground Cloth; Fieldbook (Third Edition); no date; p. 51; Irving, Texas.
Michael Hodgson; Part 1: Planning Your Escape—The add-on purchase; Camping for Dummies; Copyright 2000; p. 26; IDG Books Worldwide, Inc.; Foster City, CA.

* cited by examiner

*Primary Examiner*—Tara Mayo-Pinnock

(57) ABSTRACT

A ground cloth is adapted for use between the ground and a ground engagable floor to protect the floor from contamination by the ground. The ground cloth includes a plurality of drain holes for draining to the ground moisture entering between the ground engagable floor and the ground cloth to minimize the retention of moisture between the ground cloth and the floor.

19 Claims, 4 Drawing Sheets

TENT GROUND CLOTH WITH DRAINAGE

TECHNICAL FIELD

This invention relates to ground cloths for use between the ground and a ground engagable floor of a tent or similar enclosure for protecting the floor from dirt, abrasive wear and ground moisture.

BACKGROUND OF THE INVENTION

Ground cloths formed of thin, flexible, light weight, easy to clean, waterproof (nonporous) sheets are known in the art for protecting tent floors from dirt, abrasive wear, and ground moisture. Such ground cloths are commonly sized slightly smaller than a tent floor, or footprint, so that moisture dripping down the sides of a tent will not land on exposed portions of the ground cloth and collect under the tent floor, between the ground cloth and the tent. With tent floors that are not entirely waterproof, such moisture tends to seep into the tent through the tent floor.

Ground cloths formed of DUPONT™ TYVEK® have also been proposed. TYVEK® is a high-density polyethylene material that, while not considered to be strictly waterproof, is designed to resist water penetration. Consequently, it does not have the ability to quickly drain away the quantities of water that may accumulate during a rainstorm.

Conventional wisdom relative to tent ground cloths is that a ground cloth should be waterproof. However, a ground cloth capable of protecting a tent floor from dirt, abrasion and ground moisture, while also limiting the retention of moisture between the tent floor and the ground cloth, is desired.

SUMMARY OF THE INVENTION

The present invention provides an improved ground cloth formed of a thin, lightweight, easy to clean, durable sheet, that is adapted for use between the ground and a ground engagable floor of a tent, or the like, to protect the floor from contamination by the ground. The ground cloth includes a plurality of drain holes through the sheet adapted to drain moisture through the sheet to the ground to prevent the retention of moisture between the ground engagable floor and the ground cloth.

The number, size, arrangement and spacing of the drain holes may be constant or may vary depending upon the application. For example, the diameters of circular drain holes may vary in a range of from 0.1 mm to 3.0 mm and the spacing between the holes may vary in a range of from 2.5 mm to 50.0 mm so that the drain holes make up between 0.1 percent and 10 percent of the ground cloth surface area. In addition, the ground cloth may be sized having edge dimensions smaller or larger than edge dimensions of an associated ground engagable floor.

These and other features and advantages of the invention will be more fully understood from the following description of certain specific embodiments of the invention taken together with the accompanying drawings.

DETAILED DESCRIPTION OF THE INVENTION

The term ground cloth refers to a sheet of porous or nonporous material which, may be modified to include drain holes added after or included during manufacture. A ground cloth of this invention is primarily intended for use under a tent floor to protect it from contamination by dirt or moisture on the ground. It could also be used under ground engaging floors that are not part of a tent, such as a sleeping bag, screen house, storage unit or other portable or semi-portable enclosure.

The term generally nonporous material is intended to include materials that are waterproof (nonporous) or water resistant but permeable.

Figure 1:
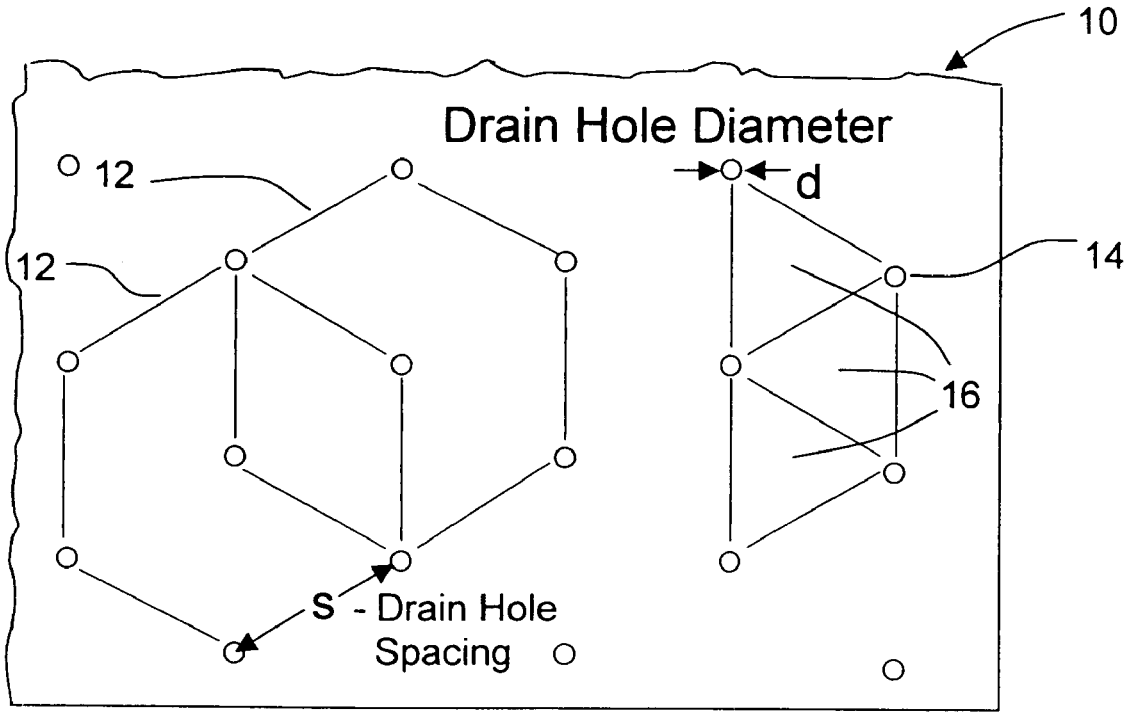
FIG. 1 is a plan view of a portion of a ground cloth according to the present invention enlarged to show an exemplary pattern of drain holes.

FIG. 1, shows a portion of a representative ground cloth 10 of the present invention, shown enlarged to illustrate an overlapping hexagonal pattern 12 of drain holes 14. The pattern 12 is formed by adjacent triangles 16 having a constant drain hole spacing S between circular drain holes of diameter D. The overlapping hexagonal pattern is an effective one for drainage since, in comparison to a square pattern with the same hole spacing S, a greater percent of the total ground cloth area lies within circles of diameter S centered on the holes. Consequently, for a given hole spacing S, the overlapping hexagonal pattern results in a lower average travel distance for water to reach a drain hole than would a square pattern. Still, other drain hole patterns may be selected if desired and the dimensions D and S may be varied within appropriate limits to be subsequently described.

The ground cloth 10 has a sheet thickness, not shown, which may vary to provide suitable strength, flexibility and weight of the sheet material used to form the ground cloth. Any suitable plastic ground cloth material may be utilized, for example, polyethylene sheet having a thickness in a range of 2-10 mils. In exemplary embodiments, the edge dimensions of a rectangular ground cloth 10 range from 2 feet by 7 feet to 10 feet by 18 feet.

Figure 2:
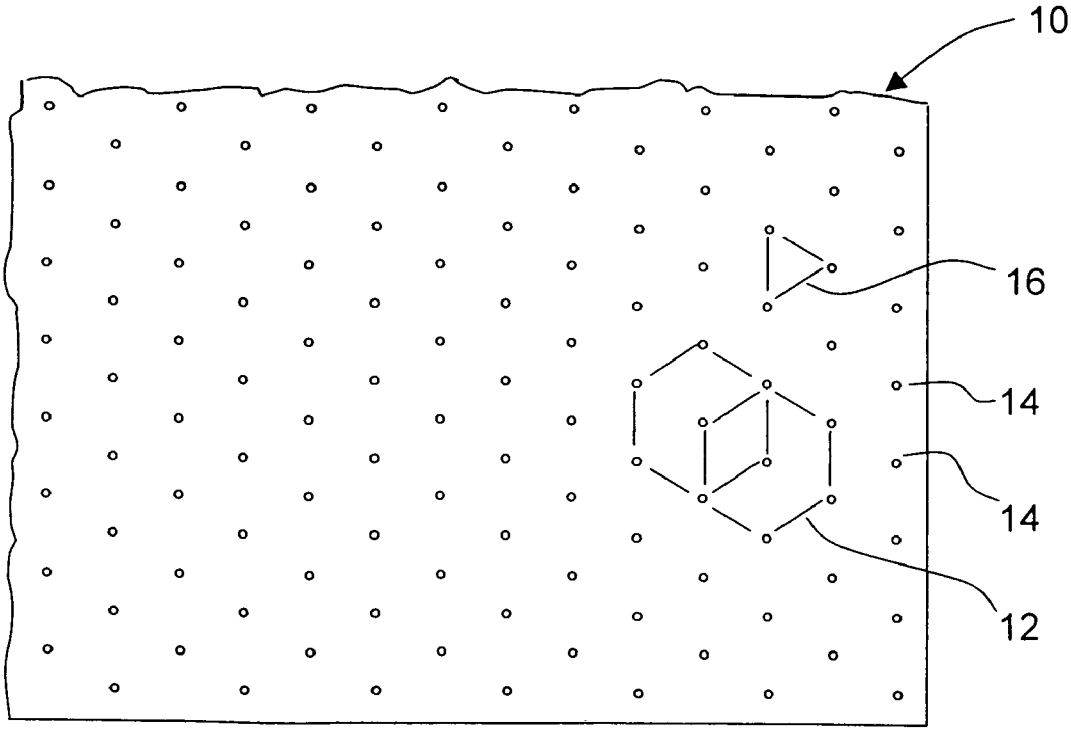
FIG. 2 is a plan view of a first embodiment of a portion of a ground cloth having the hole arrangement of FIG. 1.

FIG. 2 shows a first preferred embodiment of ground cloth 10 having the drain hole pattern of FIG. 1 and wherein the drain holes 14 have nominal diameters D of about 1.0 mm and a spacing S of about 10 mm.

Figure 3:
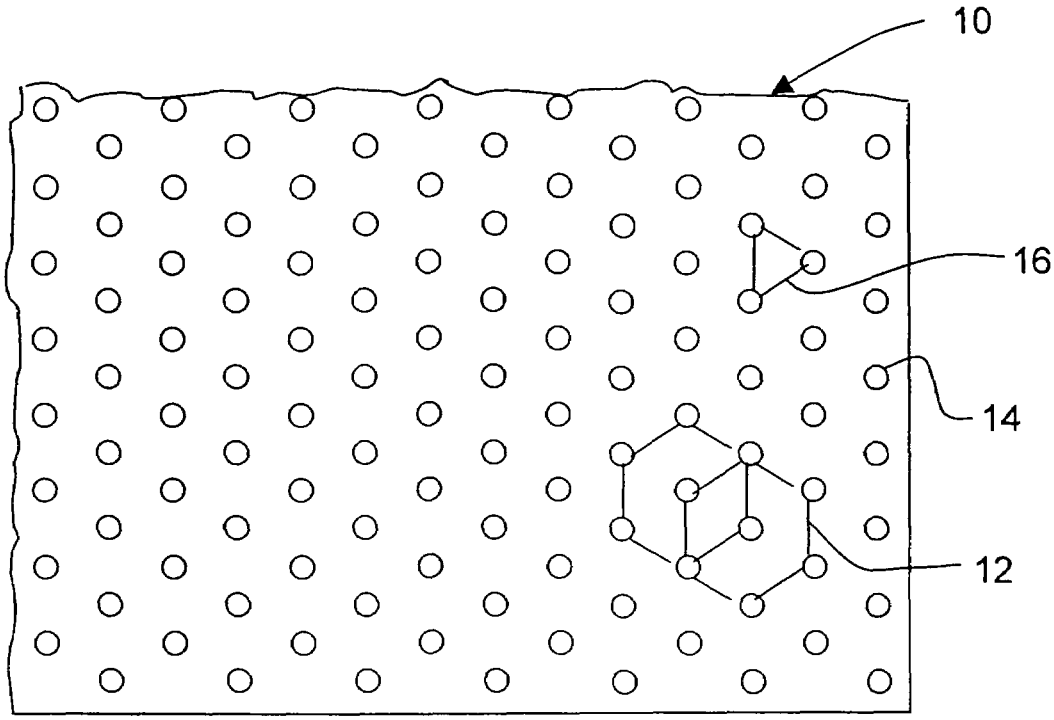
FIG. 3 is a view similar to FIG. 2 of an alternative embodiment with larger drain holes.

FIG. 3 shows a variation of ground cloth 10 having the drain hole pattern of FIG. 1 and wherein the drain holes 14 have nominal diameters D of about 3.0 mm and a spacing S of about 10 mm.

Figure 4:
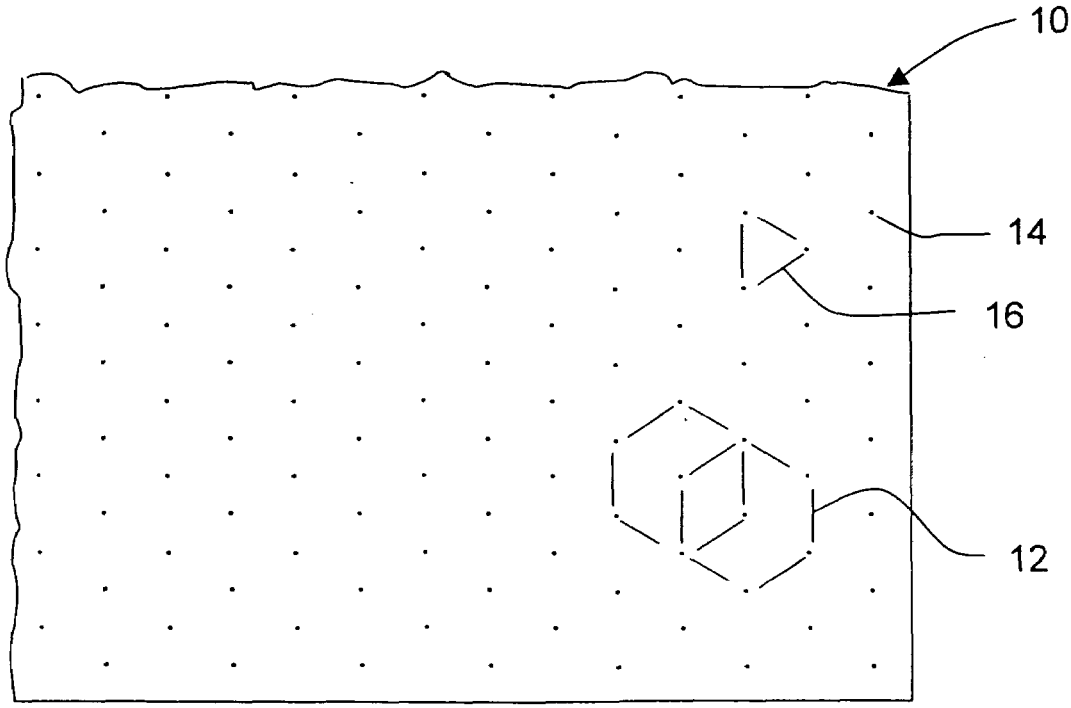
FIG. 4 is a view similar to FIG. 2 of an alternative embodiment with smaller drain holes.

FIG. 4 shows another variation of ground cloth 10 having the drain hole pattern of FIG. 1 and wherein the drain holes 14 have nominal diameters D of about 0.3 mm and a spacing S of about 10 mm.

Figure 5:
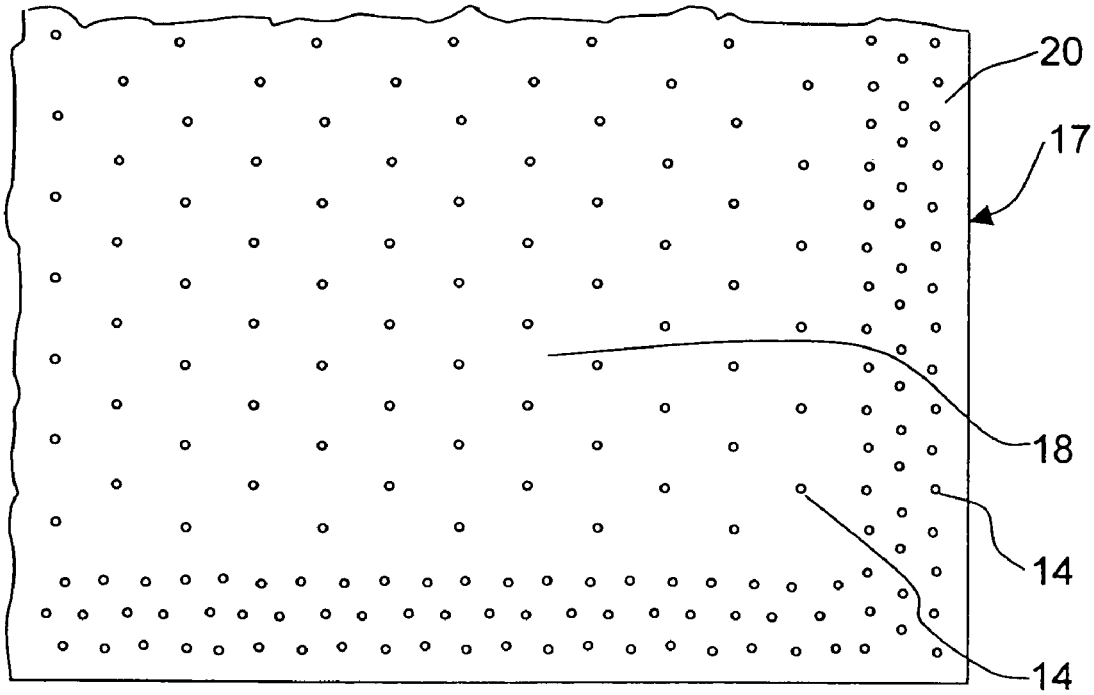
FIG. 5 is a view similar to FIG. 2 of a corner portion of an alternative embodiment having increased drain hole density along outer edges of the ground cloth.

FIG. 5 shows an alternative embodiment of ground cloth 17 having a center portion 18 with a drain hole pattern similar to FIG. 1 and an edge portion 20 with a differing drain hole pattern. The drain holes 14 in the center portion 18 have nominal diameters D of about 1.0 mm and a spacing S of about 10 mm. However, the drain holes 14 in the edge portion 20 retain nominal diameters D of about 1.0 mm with a spacing S of less than 10 mm to increase the density of the drain holes at the edge portion.

The edge portion 20 preferably has a drain hole area ratio that is 2 to 4 times that of the center portion 18 of the ground cloth. Thus, if the center portion 18 has a drain hole ratio of 1 percent, the edge portion 20 may have a drain hole ratio of from 2 to 4 percent.

It should be understood that the diameters D of the drain holes 14 and spacing S between the drain holes as illustrated in FIGS. 2-5 are merely exemplary. Accordingly, the diameters D of the drain holes 14 preferably lie in a range of from 0.1 mm to 3.0 mm and the spacing S between the drain holes preferably lies in a range of from 2.5 mm to 50 mm. Based on the upper end of the preferred range of hole spacing S, and a uniform square pattern of holes, it also follows that it is preferable that greater Than 75% of the total ground cloth area would lie within circles of 50 mm diameter (25 mm radius) centered on the holes.

Preferably, the surface area of the drain holes 14 should constitute between 0.1 and 10 percent of the total surface area of ground cloth 10 or 17. This ratio provides adequate moisture flow rates (greater than 10 mm of liquid per hour) to prevent the retention of moisture between the floor and the ground cloth while minimizing contact between the floor and the ground to reduce abrasive wear and dirt transfer to the tent floor.

In use, a ground cloth 10 or 17 is initially spread over the ground and a tent 22 having a floor 24 is erected over the ground cloth.

Figure 6:
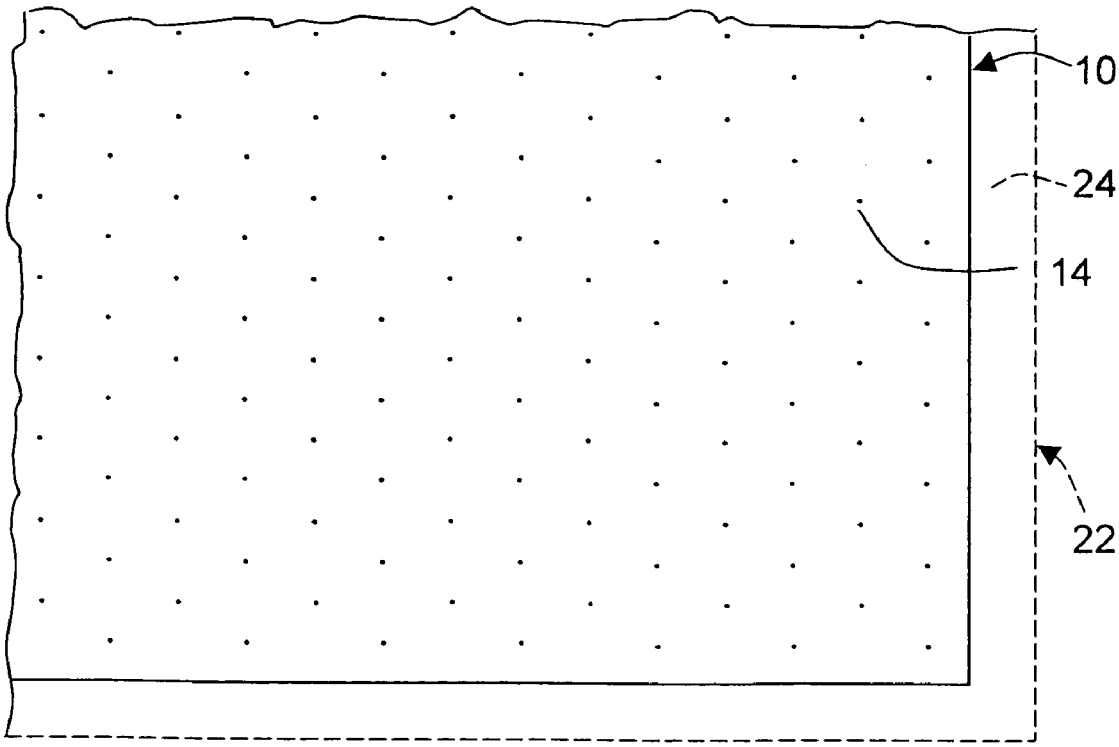
FIG. 6 is a plan view illustrating an exemplary ground cloth with a repetitive drain hole pattern similar to FIGS. 2-4 and having smaller edge dimensions than the footprint of an associated tent.

FIG. 6 illustrates the relationship between a tent floor 22 and a ground cloth 10 having drain holes 14 configured as shown in FIG. 1. The tent floor 24 has larger edge dimensions than the ground cloth 10 so that the tent floor slightly overhangs the ground cloth. The edge dimensions of the ground cloth fall within 95-105 percent of the specified dimension of the tent floor has been inserted.

As the tent 22 is exposed to moisture in the form of rain or dew, the moisture tends to run down the sides of the tent, not shown, onto the ground surrounding the tent. However, a portion of the moisture draining from the sides of the tent 22, or flowing along the ground, may seep below the floor 24 and between the ground cloth 10 and the floor. As moisture travels between the floor 24 and the ground cloth 10, toward low spots in the ground, the moisture is drained through the drain holes 14 to the ground. This reduces moisture retention between the floor 24 and the ground cloth 10 and thereby minimizes moisture transfer through the floor.

In addition to the simple drainage of water through the drain holes, the holes enable a vapor transport mechanism to remove either residual moisture that remains after any bulk water has drained out, or ground moisture that may on occasion come up through the holes. The vapor transport mechanism is driven by a tent interior temperature that is greater than the ground temperature, a situation that will usually exist due to heat provided by one or more of the following elements—the sun, the atmosphere or tent occupants. The temperature gradient will generate a vapor pressure gradient across the ground cloth, and thus a flow bias that results in a net transport of moisture through the holes to the ground below. In spite of the presence of holes, a tent is therefore effectively isolated from ground moisture by the present invention.

Figure 7:
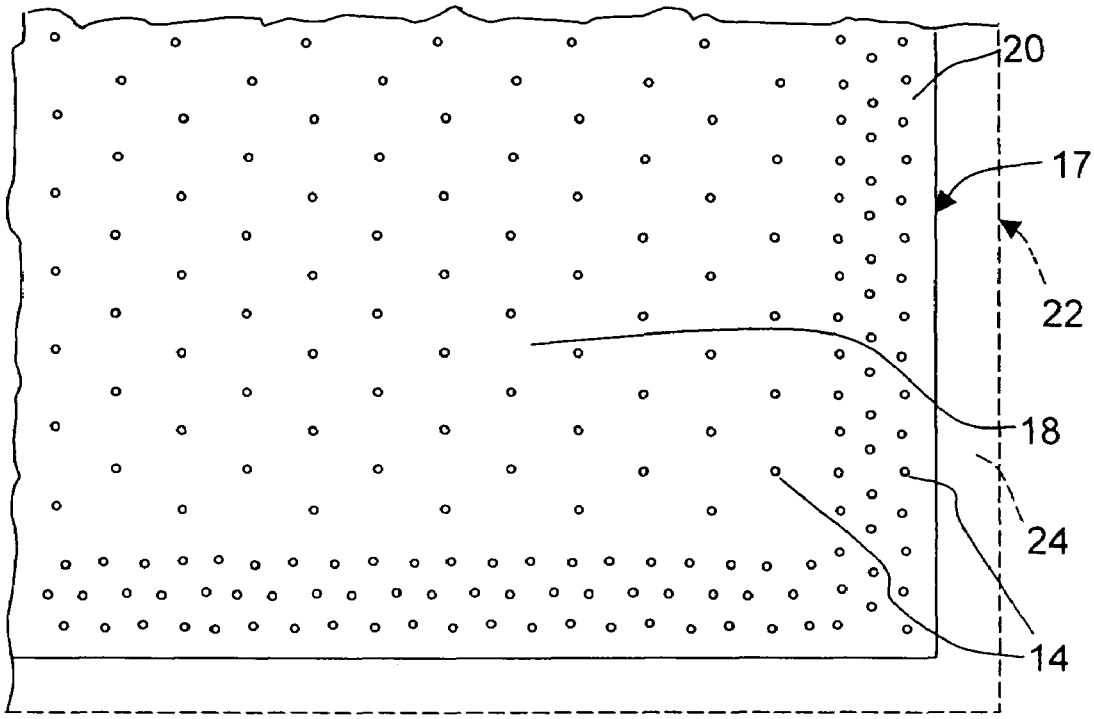
FIG. 7 is a plan view of a ground cloth similar to FIG. 5 and having smaller edge dimensions than the footprint of an associated tent.

FIG. 7 illustrates the relationship between a portion of a tent floor 24 and a ground cloth 17 having drain holes 14 configured as shown in FIG. 5. The tent floor 24 has larger edge dimensions than the ground cloth 17 so that the tent floor slightly overhangs the ground cloth.

As moisture first flows over the edge portion 20 of the ground cloth 17, the edge portion 20, having a higher drainage surface area, drains a majority of the moisture to the ground to reduce the likelihood of moisture reaching the center portion 18 of the ground cloth. The center portion 18 having less drainage surface area allows any errant moisture that has passed the edge portion 20 to be directed into the ground. The lower drainage surface area of the center portion 18 also minimizes contact between the floor and the ground to reduce ground abrasive wear and dirt transfer to the floor.

Figure 8:
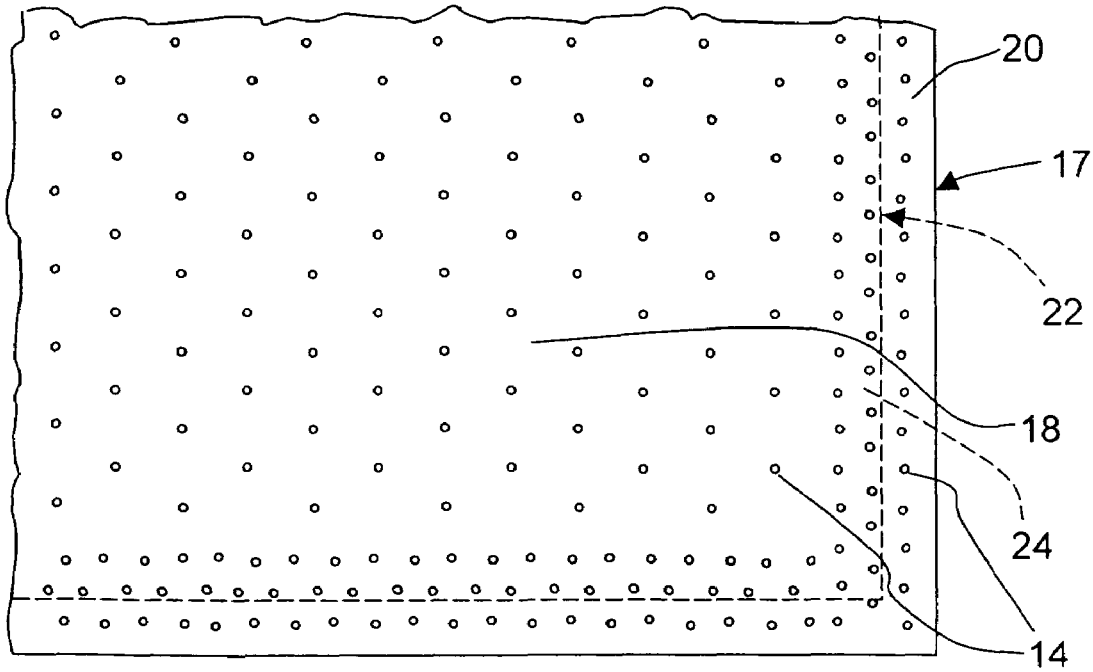
FIG. 8 is a plan view similar to FIG. 7 but having larger edge dimensions than the footprint of an associated tent.

FIG. 8 illustrates the relationship between a corner portion of a tent floor 24 and a corner portion of a ground cloth 17 having drain holes 14 configured as shown in FIG. 5. The tent 22 has smaller edge dimensions than the ground cloth 17, causing the edge portion 20 of the ground cloth to extend slightly outward beyond the floor of the tent.

As the tent 22 is exposed to moisture in the form of rain or dew, the moisture tends to run down the sides of the tent onto the edge portion 20 of the ground cloth 17. The edge portion 20 having a higher drainage surface area extending beyond the edge of the tent, drains a majority of the moisture to the ground to reduce the likelihood of moisture reaching a center portion 18 of the ground cloth. The center portion 18 having less drainage surface area allows any errant moisture that has passed the edge portion 20 to be directed to the ground. The lower drainage surface area of the center portion 18 also minimizes contact between the floor and the ground to reduce ground abrasive wear and dirt transfer to the floor.

If desired, the circular drain holes, previously discussed, may be replaced with various other shapes, such as slits, squares, rectangles, polygons, ovals.

Although the invention has been described by reference to certain specific embodiments, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method for reducing exposure of a ground engagable floor of a tent to dirt, abrasion, and moisture comprising:

(a) providing a single layer ground cloth comprising:

one and not more than one flexible sheet of generally non-porous material of substantially constant thickness and configured for use between the floor and supporting ground;

the flexible sheet including a plurality of drain holes through the material and effective for draining to the ground moisture from between the floor and the sheet;

wherein the areas of the individual drain holes have values in the range given by the areas of circular holes having diameters in the range of from 0.1 mm to 3.0 mm; and the drain holes in that portion of the flexible sheet engaged by the ground engagable floor are of sufficient number and distributed such that greater than 75% of the area of said portion lies within 25 mm of a drain hole; and the total area of the drain holes in that portion of the flexible sheet engaged by the ground engagable floor is not more than 10 percent of the corresponding area of the flexible sheet to maintain protection from engagement with the ground of at least 90 percent of a corresponding portion of the floor engaged by the flexible sheet;

(b) disposing the single layer ground cloth between the ground engagable floor and supporting ground;

whereby water that enters the space between the single layer ground cloth and the ground engagable floor is drained away while at least 90 percent of the ground engagable floor engaged with the single layer ground cloth is protected from engagement with the ground.

2. The method of claim 1 wherein the range of circular hole diameters is from 0.5 mm to 2.0 mm.

3. The method of claim 1 wherein the drain holes are substantially circular.

4. The method of claim 3 wherein a major portion of the drain holes are about 1.0 mm in diameter.

5. The method of claim 1 wherein average porosity provided by the drain holes in the flexible sheet is in a range of from 0.1 percent to 10 percent.

6. The method of claim 5 wherein the average porosity of a pattern made by the drain holes in the flexible sheet is not greater than about 1.1 percent.

7. The method of claim 1 wherein the material of the flexible sheet is a durable and flexible plastic having a thickness in the range of 2-10 mils.

8. The method of claim 1 wherein nominal features of the flexible sheet include circular drain holes of about 1.0 mm diameter arranged in overlapping hexagonal patterns with center to center distances of about 10 mm between holes and wherein the material of the flexible sheet is durable and nonporous between the holes and has a thickness in the range of 4-8 mils.

9. The method of claim 1 wherein the material of the flexible sheet is durable and nonporous between the holes and has a thickness in the range of 4-8 mils and wherein the average porosity provided by the drain holes in the flexible sheet is in a range of from 0.1 percent to 2 percent.

10. The method of claim 1 wherein edge dimensions of rectangular configurations of the ground cloth range between about 2 feet by 7 feet to about 10 feet by 18 feet.

11. The method of claim 1 wherein an edge portion of the flexible sheet has a higher percentage of drain hole surface area than a center portion of the sheet.

12. The method of claim 1 wherein the edge dimensions of the single layer ground cloth fall within 95-105 percent of the edge dimensions of the ground engagable floor.

13. The method of claim 1 wherein the drain holes in that portion of the flexible sheet engaged by the ground engagable floor are of sufficient number and distributed such that greater than 75% of the area of said portion lies within 10 mm of a drain hole.

14. The combination of a tent having a ground engagable floor and a single layer ground cloth below and engaging the floor to protect the floor from contamination by the ground, wherein the ground cloth comprises:

one and not more than one flexible sheet of generally non-porous material of substantially constant thickness and configured for use between the floor and supporting ground;

the flexible sheet including a plurality of drain holes through the material and effective for draining to the ground moisture from between the floor and the sheet;

wherein the areas of the individual drain holes have values in the range given by the areas of circular holes having diameters in the range of from 0.1 mm to 3.0 mm; and the drain holes in that portion of the flexible sheet engaged by the ground engagable floor are of sufficient number and distributed such that greater than 75% of the area of said portion lies within 25 mm of a drain hole; and the total area of the drain holes in that portion of the flexible sheet engaged by the ground engagable floor is not more than 10 percent of the corresponding area of the flexible sheet to maintain protection from engagement with the ground of at least 90 percent of a corresponding portion of the tent floor engaged by the flexible sheet.

15. The combination of claim 14 wherein the material of the flexible sheet is durable and nonporous between the holes and has a thickness in the range of 2-10 mils.

16. The combination of claim 15 wherein the porosity of a pattern made by the drain holes in that portion of the flexible sheet engaged by the ground engagable floor is not greater than about 1.1 percent.

17. The combination of claim 15 wherein an edge portion of the flexible sheet has a higher percentage of drain hole surface area than a center portion of the sheet.

18. The combination of claim 15 wherein nominal features of the flexible sheet include circular drain holes of about 1.0 mm diameter arranged in overlapping hexagonal patterns with center to center distances of about 10 mm between holes.

19. The combination of claim 14 wherein the drain holes in that portion of the flexible sheet engaged by the ground engagable floor are of sufficient number and distributed such that greater than 75% of the area of said portion lies within 10 mm of a drain hole.

* * * * *